US005636183A

United States Patent [19]

Boucher et al.

[11] Patent Number: 5,636,183

[45] Date of Patent: Jun. 3, 1997

[54] PROCESS AND TRANSDUCERS SUBMERGED IN A FLUID FOR EMITTING LOW FREQUENCY ACOUSTIC WAVES WITH LIGHTENED HORNS

[75] Inventors: Didier J. M. Boucher; Yves Y. Ripoll, both of Six Fours les Plages, France

[73] Assignee: Etat Francais as represented by the Delegue General pour l'Armement, Paris, France

[21] Appl. No.: 601,523

[22] Filed: Feb. 14, 1996

[30] Foreign Application Priority Data

Feb. 23, 1995 [FR] France ..... 95 02092

[51] Int. Cl.[6] ..... B06B 1/00; H04R 1/28

[52] U.S. Cl. ..... 367/173

[58] Field of Search ..... 367/162, 158, 367/163, 174, 188, 138, 173

[56] References Cited

U.S. PATENT DOCUMENTS

| | | | |
|---|---|---|---|
| 5,130,953 | 7/1992 | Grosso | 367/155 |
| 5,363,345 | 11/1994 | Boucher et al. | 367/162 |

FOREIGN PATENT DOCUMENTS

| | | |
|---|---|---|
| 2109466 | 5/1994 | Canada . |
| 0462037 | 12/1991 | European Pat. Off. . |
| 2665998 | 2/1992 | France . |
| 0596763 | 5/1994 | France . |

*Primary Examiner*—Daniel T. Pihulic
*Attorney, Agent, or Firm*—Oliff & Berridge

[57] ABSTRACT

The object of the present invention is a process wherein transducers submerged in a fluid for emitting low frequency acoustic waves with lightened horns are used to reduce the frequency of emission for a given maximum power consumption of the transducer. The transducer transmits waves in a frequency range according to the given maximum power consumption and a given electro-acoustic efficiency. The transducer comprises at least one horn solid with the extremity of a motor pillar and a rigid box. The rigid box encloses the motor pillar and has determined dimensions and external volume, and further includes a dynamic load solid with the rigid box. The dynamic load partially closes an inside section of the rigid box and divides an internal cavity into a front cavity and rear cavity. The front and rear cavities communicate.

9 Claims, 2 Drawing Sheets

PROCESS AND TRANSDUCERS SUBMERGED IN A FLUID FOR EMITTING LOW FREQUENCY ACOUSTIC WAVES WITH LIGHTENED HORNS

BACKGROUND OF THE INVENTION

1. Field of Invention

The present invention relates to a process and transducers submerged in a fluid for emitting low frequency acoustic waves with lightened horns. The technical sector of the invention is that of the realisation of electro-acoustic submersible transducers.

The main application and the objective of the invention is the possibility, either to reduce the power consumption of a given submersible transducer comprising at least one horn and one motor pillar for emitting waves in a low frequency fluid, in fact lower than 500 hz, or to reduce the said frequency range of a given transducer for the same acoustic power, or both at the same time.

2. Background of the Invention

Such submersible electro-acoustic transducers are known and in particular the piezo-electric ones, comprising a hollow rigid cylindrical box, open at both axial ends, and within which two identical electro-acoustics motors are arranged coaxially with the latter, located on both sides of a central counter-mass, and whose opposite extremities are surrounded by a horn: these transducers are called double "Tonpilz". The said electro-acoustic motors can consist of two stacks of piezo-electric plates in line. The external faces of both horns are located in the plan containing the axial extremities of the box, so that they are in contact with the liquid, in which the box is immersed, and the external perimeter of these horns is close to the edge of the open axial ends of the said box.

Thus, these external faces emit acoustic waves into the liquid when the electro-acoustic motors are excited electronically; these transducers are notably used to emit low frequency acoustic waves in water, in a determined direction; for an application of this type of mono or double "Tonpilz" transducer to high power emissions, application FR. 2.663.182 from Mr Gilles GROSSO published on Dec. 13, 1991 can be mentioned, which describes the complementary devices to obtain an increase in power.

In order to avoid the propagation of the acoustic waves emitted by the horn rear faces, inside the box, especially when the latter is in fact full of liquid, and which are then retransmitted in the ambient medium in spite of the rigidity of the said box, various means are arranged in the cavity filled with ambient liquid to the rear of the horns of such non sealed boxes, such as elastic tubes closed at both ends and filled with gas, and such that the frequency of Helmholtz resonance of the cavity is near the fundamental frequency of the axial vibrations of the vibrating assembly; such a device is described in patent application FR. 2.665.998 of May 5, 1988 filed by Etat Français, the General Delegate for Armament. The problem of the resistance is thus transferred to the pressure of the external box, to the resistance of the said elastic tubes, which, having smaller diameters, make it possible to have a less heavy assembly; other means can be developed in the same objective and be applied to the present invention, being known that these devices must provide a cavity, at the rear face of the horns, with sufficient dimensions.

Moreover, when, according to the objectives of the present invention, one wants to increase the electro-acoustic efficiency and therefore the power really emitted, which is increasingly requested presently especially in utilisations where the volume of energy storage is critical, while reducing the frequency under 500 hz, it is necessary to reduce the resonant frequencies of the motor and resonator; the resonant frequency being that of the transducer disunited from the acoustic load of the resonator. Usually, the reduction of the resonant frequency of the motor is obtained either by increasing the mass of the horns, or by reducing the section of ceramics of the motors (which in addition weakens them), thus reducing the maximum sound level emitted and which is contrary to the wanted objective. To avoid this power loss, it is therefore possible to choose to increase the mass of the horns and at the same time on the one hand the volume of the electro-acoustic motors, which results in an elongation of the latter and, on the other hand the rigidity and electromechanical coupling coefficient between the motors and horns; however the external volume of the transducer and its weight must then be increased, if not, a lower conversion of power is obtained; in any case, even if the power is increased at a low frequency, the acoustic efficiency remains average.

The problem is therefore the possibility of reducing the resonance frequency of a transducer motor for a given maximum power consumption and/or increasing its acoustic efficiency at low frequency in order to increase the acoustic power also without increasing the dimensions and weight.

SUMMARY OF THE INVENTION

A solution to the problem is a process of emitting acoustic waves in a low frequency fluid from a transducer comprising at least one horn solid with the extremity of a motor pillar, a rigid box delimiting a cavity with the said horn, the said cavity enclosing the said motor pillar and having determined dimensions and external volume, the said transducer transmitting waves in a frequency range, with the power and according to a given electro-acoustic efficiency: according to the invention behind the said horn inside the said box, a dynamic load solid with the latter is arranged, which partially closes its inside section and divides the said inside cavity in two communicating pars, rear and front; the peripheral external edge of the horns is approached to the internal wall of the box, preferably a few tenths of a millimeter away; then acoustic waves are emitted at frequencies lower than that of the given initial range and with the same given initial maximum power consumption.

Preferably, the said embodied transducer is used in a frequency range surrounding that of the rear cavity thus delimited by the said dynamic load; the definition and various types of embodiment of the latter are described in the presentation of FIG. 1.

The result is new processes and transducers submerged in a fluid for emitting low frequency acoustic waves of which the motor resonance frequency has been reduced without increasing the dimensions or weight in relation to a given transducer of the same type. Indeed, the presence of the said dynamic load makes it possible to indirectly increase the mass of the horn by association of a mass of liquid located between the latter and the said dynamic load; since the latter closes only partially the inside section of the box, the liquid can however pass from the so-called front cavity to the so-called rear cavity while being slowed down according to the surface ratio between the free surface of the conduit left by the said dynamic load and the whole internal surface of the box;

a virtual mass of the horn is obtained all the larger as this surface ratio is high. It can also be noticed that the nature of the material constituting the said horn is not very important since it is the mass of liquid which can be added to the latter which is more important in relation to its possibility of displacement through the said dynamic load. So, it can be considered that a horn of approximately 15 kg in material of the aluminium type has the same capacities of vibration and therefore of acoustic power as a 150 kg horn. The frequency can therefore be decreased to under 1,000 hz and especially in very low frequency down to 100 or 200 hz from a same transducer, without having to make its horn heavier such as in the techniques used up to now. It is also possible either to decrease the required power consumption for the same power of emission, or to increase the latter for the same power consumption for a given frequency as illustrated in FIG. 2.

Other advantages of the present invention could be mentioned but the ones mentioned hereabove show enough to prove the novelty and interest. The hereafter description and figures represent one example of embodiment of the invention but they have no limiting character; other embodiments are possible within the framework of the range of this invention, in particular by changing the shape of the dynamic load such as it is represented as an example in FIG. 1.

BRIEF DESCRIPTION OF THE DRAWINGS

The invention will be described in detail with reference to the following drawings, wherein like reference characters refer to like elements and.

DETAILED DESCRIPTION OF THE INVENTION

First of all, we note that the present invention can apply to all types of submersible transducers comprising at least one horn and one motor pillar, even if in the example mentioned hereunder, to simplify the description and since it is a principal application of the invention, only the horns coupled to electro-acoustic motors of transducers of the double "Tonpilz" type with a cylindrical shape of revolution have been described.

Figure 1:
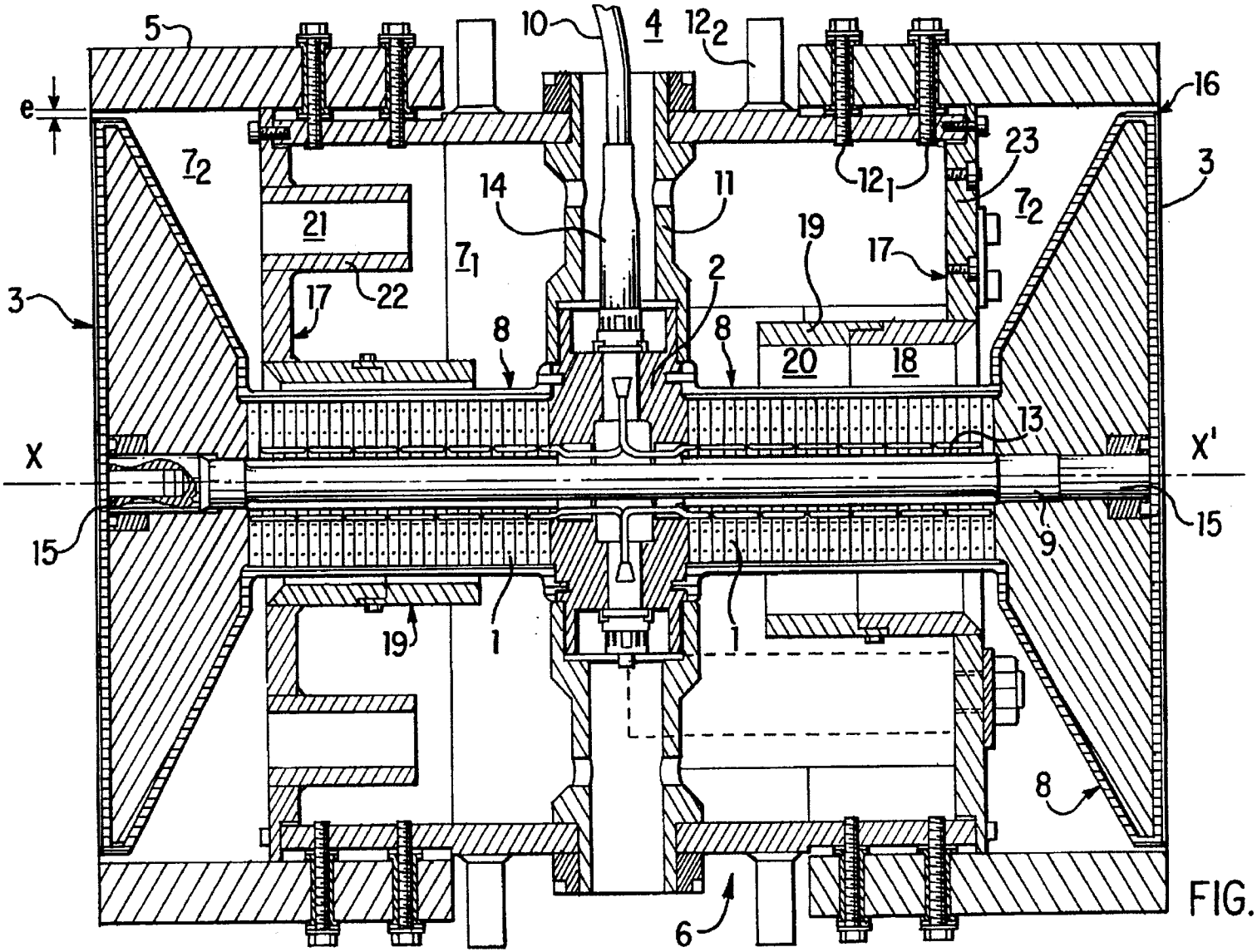
FIG. 1 is an axial cutaway of a transducer of the type previously indicated and defined hereafter and equipped with two types of dynamic load according to the invention.

The transducer as it is represented in cutaway view here in this FIG. 1, comprises therefore in a known manner, two electro-acoustic motors 1 in line on a xx' axis, arranged coaxially inside a cylindrical box 5, which can be called external, covering all the said motors 1 until horn 3 of extremity of the latter, cavity 7, thus delimited by the said horns and the said box being filled with liquid 4 in which the whole transducer is submerged, such as sea water.

Said electro-acoustic motors 1 and intermediate mass 2 are on the one hand, held together by a preconstraint rod 9, also immobilising by any means of assembly 15 the two horns 3 on the ends of the thus constituted pillar, and on the other hand, assembled by means of various connecting parts 11, which are associated to various fastening parts 12, some of them $12_1$ connecting the said electro-acoustic motors to external box 5 and the others $12_2$ making it possible to attach the whole transducer onto any external support. The various fastening means are such that they allow a free displacement of the extremities of the electro-acoustic motors on the side of horns 3, which are solid with them and whose peripheral external edge 16, not connected and independent of the internal wall of box 5, can then vibrate freely in order to ensure the total emission of acoustic waves in the ambient medium.

An internal sheath 13 isolates the preconstraint rod from the said motors 1, and an external sealing envelope 8 ensures the insulation of motors 1 and horns 3 in relation to ambient medium 4.

The said electro-acoustic motors 1 are supplied by any feeder cable 10 attached to the said connecting pieces 11 by an electric connector 14. The embodiment of such a transducer and all the various connecting pieces which constitute it are well known and can be embodied by any skilled person; all the other elements which make it possible in particular to obtain the Helmholtz resonance frequency of the cavity as indicated in the introduction, as well as the various connecting elements allowing the improvement of the mechanical embodiment of the whole are not shown here; for some of them various other patent applications have been filed as in particular, the ones mentioned in the introduction for so-called compliant tubes.

To allow the filling of cavity 7 by the said liquid 4, the said external box 5 comprises at least one opening 6 to communicate with the outside, and the said opening can be made of holes distributed around the cylindrical part of the box or even made of a complete circular peripheral opening.

According to the present invention, the said transducer, such as represented in FIG. 1, comprises behind each horn 3, in this case, the two horns represented, an inside box 5, a dynamic load 17 associated to each horn, solid with said box 5 and partially closing its inside section by dividing internal cavity 7 into two communicating parts, rear part $7_1$ and front part $7_2$: in the representation in FIG. 1, this means, in fact, dividing all of the internal cavity of the box into three cavities, among which a single central rear one $7_1$ is median and two cavities called "front" $7_2$ each being located behind each of the two horns 3.

According to the representation of the dynamic load on the right hand side of the figure, the latter consists of a full wall 23 following the shape of the internal wall surface of box 5 and solid with it, surrounding motor pillar 1 and with at least one drilled port 18 through which the latter passes, the said port comprises a conduit 19 extending to the rear part of wall 23 in relation to horn 3 and leaving a free peripheral passage 20 around said motor pillar 1.

According to the representation of dynamic load 17 on the part of the figure located on the left hand side, the said full wall 23 comprises, like on the right hand side, a port 18 through which the said motor pillar 1 passes but the peripheral passage 20 is narrower and comprises in addition various other ports 21 arranged around the said motor pillar 1 and supporting open conduits 22.

In all cases, walls 23 are attached at their periphery to rigid box 5 by the elements and connecting pieces 12.

As represented in FIG. 1, the said walls 23 of both dynamic loads are located close to the rear part of horn 3, but they could be located at a longer distance since what matters in order to constitute the additional mass of the fluid to be added to that of the horns and located in cavities $7_2$ is above all the ratio of the surfaces of all the conduits 21 and 20 in relation to the total section of box 5 which also corresponds to that of the diameter also for horns 3, and not the effective mass of the fluid located in these cavities $7_2$ and included between the said horn and the said dynamic load.

On the contrary, distance "e" between the peripheral external edge 16 of horns 3 and the internal box wall must be as small as possible, at least less than 1 mm and preferably some tenths of a millimeter, in such a way that this space allows only little leakage of liquid from cavity $7_2$ to the outside during vibration, so that the said fluid especially solicits dynamic load 17 to thus virtually increase the mass of horn 3 and then reduce, with an equal weight and volume in relation to the latter, its emitting frequency for the same power consumption.

Moreover, the acoustic efficiency is maximum around the resonance frequency of cavity $7_1$; indeed, the acoustic losses being proportional to the speed flux of horns 3 and conduits 21 and 20, the losses are minimum for these frequencies since the flux participating in the radiation is mainly generated by the openings of box 6 which present only little loss. So, for applications requiring a high electro-acoustic efficiency, this type of transducer must be used around the resonance frequency of cavity $7_1$.

Figure 2:
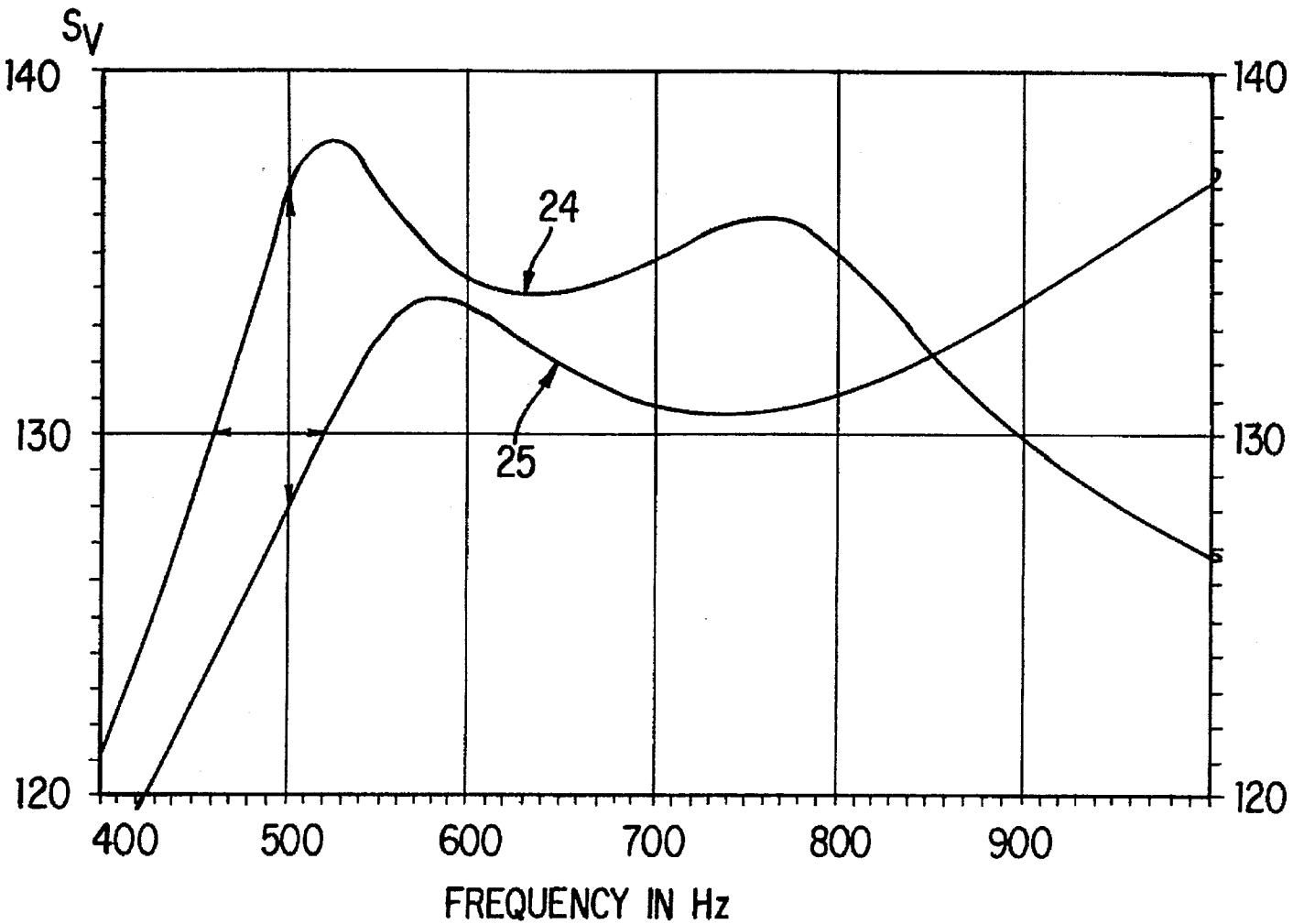
FIG. 2 represents acoustic power comparative curves, between a standard transducer and a transducer of the same type equipped with the said dynamic load in relation to the emitted frequency.

FIG. 2 represents a curve 24 of a transducer acoustic power emission as represented in FIG. 1 with a dynamic load according to the invention, while curve 25 represents the same transducer but not equipped with the said dynamic load, the said power of emission being recorded in relation to the frequencies in herz.

It is thus noted that in frequencies under 800 hz and such that, around the frequency of 500 hz, for instance, the emitted power is increased in a significant proportion or inversely, for the given power, the frequency of more than 50 hz is reduced. Of course, this has been measured from a given type of transducer, but with other transducers, it is possible to obtain an even larger gain, to reduce the frequency of emission and/or both at the same time, without making the horns of the given transducer heavier.

While this invention has been described in conjunction with the above outlined specific embodiments thereof, it is evident that many alternatives, modifications and variations will be apparent to those skilled in the art. Accordingly, the preferred embodiments of the inventions as set forth above are intended to be illustrative, not limiting. Various changes may be made without departing from the scope and spirit of the invention.

We claim:

1. A process for emitting low frequency acoustic waves into a fluid from a transducer for transmitting waves within a frequency range using a determined input power and according to a given electro-acoustic efficiency, wherein a) the transducer comprises at least one horn solid with an extremity of a motor pillar, a rigid box delimiting with the at least one horn an internal cavity enclosing the motor pillar and having determined dimensions and volume, b) behind said at least one horn and inside said box a dynamic load solid with the box is arranged, the dynamic load closing partially an internal section of the box and dividing the internal cavity into a front cavity and a rear cavity, the front and rear cavities communicating, and c) a peripheral external edge of said at least one horn and an internal wall of the box are close together, the process comprising emitting acoustic waves using the determined input power at frequencies lower than an initial range and at a maximum output power.

2. The process for emitting acoustic waves according to claim 1, wherein the peripheral external edge of the at least one horn and the internal wall of the box are less than a millimeter apart.

3. The process for emitting acoustic waves according to claim 1, wherein said transducer is used in a range of frequency surrounding a resonant frequency of the rear cavity.

4. A transducer submersible into a fluid for emitting low frequency acoustic waves within a frequency range using a determined input power according to a given electro-acoustic efficiency, comprising:

at least one horn solid with an end of a motor pillar;

a rigid box delimiting with the at least one horn a first cavity enclosing the motor pillar and having determined external dimensions and volume; and a dynamic load behind said at least one horn and inside the box, wherein the dynamic load is solid with the box and partially closes an internal section of the box and divides the first cavity into a rear cavity and a front cavity.

5. The transducer according to claim 4, wherein a distance between a peripheral external edge of the at least one horn and an internal wall of the box is less than 1 millimeter.

6. The transducer according to claim 4, wherein the dynamic load comprises a full wall following a shape of an internal surface of the box with which it is solid, surrounding the motor pillar and having at least one port through which the motor pillar passes, the at least one port having a conduit extending behind the full wall in relation to the at least one horn and leaving a free peripheral passage around said motor pillar.

7. The transducer according to claim 6, wherein the full wall comprises a plurality of ports arranged around the motor pillar and having open conduits.

8. The transducer according to claim 6, wherein the full wall is located close to a rear part of the at least one horn.

9. The transducer according to claim 4, wherein the box is cylindrical and encloses two identical electro-acoustic motors located on both sides of a central counter-mass, opposed extremities of the motors are each surrounded by the at least one horn, and the at least one horn is associated to the dynamic load.

* * * * *